US007229055B2

(12) United States Patent
Wallther

(10) Patent No.: US 7,229,055 B2
(45) Date of Patent: Jun. 12, 2007

(54) HOOK HOLDER FOR HOLDING SCAFFOLDING ELEMENTS TO A SCAFFOLD

(75) Inventor: Harry Wallther, Hindås (SE)

(73) Assignee: Pluseight Technology AB (SE)

( * ) Notice: Subject to any disclaimer, the term of this patent is extended or adjusted under 35 U.S.C. 154(b) by 0 days.

(21) Appl. No.: 10/475,235

(22) PCT Filed: Apr. 17, 2002

(86) PCT No.: PCT/SE02/00758

§ 371 (c)(1),
(2), (4) Date: May 13, 2004

(87) PCT Pub. No.: WO02/086255

PCT Pub. Date: Oct. 31, 2002

(65) Prior Publication Data

US 2004/0173717 A1 Sep. 9, 2004

(30) Foreign Application Priority Data

Apr. 18, 2001 (SE) ..... 0101359

(51) Int. Cl.
*E06C 7/16* (2006.01)

(52) U.S. Cl. ..... 248/211; 248/74.1; 182/222

(58) Field of Classification Search ..... 248/211, 248/74.1, 74.4, 214, 215, 229.13, 229.23, 248/227.4, 230.4, 231.51, 227.1; 182/222; 211/119.004
See application file for complete search history.

(56) References Cited

U.S. PATENT DOCUMENTS 900,889 A * 10/1908 Schuster ..... 119/806
2,068,902 A * 1/1937 Blunt ..... 248/74.1
2,811,395 A 10/1957 Jagiel
2,997,767 A * 8/1961 Grover et al. ..... 24/510
3,640,498 A * 2/1972 Aleks ..... 248/218.4
4,426,171 A * 1/1984 Layher ..... 403/49
4,700,437 A * 10/1987 Hoshino ..... 24/456
5,988,318 A * 11/1999 Krause ..... 182/222
6,168,345 B1 * 1/2001 Legge ..... 403/385
6,283,425 B1 * 9/2001 Liljevik ..... 248/230.4
6,530,456 B1 * 3/2003 Wallther ..... 182/222

FOREIGN PATENT DOCUMENTS

EP 0106492 A2 4/1984
WO WO-94/23153 A1 10/1994

* cited by examiner

*Primary Examiner*—Anita M. King
(74) *Attorney, Agent, or Firm*—Lerner, David, Littenberg, Krumholz & Mentlik, LLP

(57) ABSTRACT

Holding hook for a mutual blocking position retaining of a first type of a scaffold elements (4) at a second type of scaffold elements (5) in a scaffold and consisting of a holding part 811) that relative to an axis (9) is pivotally applied to a fixed holding part (2). This pivotally applied holding part (11) is shiftable between a holding position in which the pivoted holding part is blocked and a releasing position for the scaffold elements. The pivoted holding part (11) is also displaceable along the axis (9) and is equipped with a blocking part (13), that at a first axial displacement position in the blocking position of the holding hook blocks the pivoted holding part in its holding position by impace towards a fixed blocking surface (27) in the fixed holding part. In a second axial displacement position outside the blocking surface (27), the pivoted holding part is allowed to be shifted to a releasing position.

4 Claims, 5 Drawing Sheets

HOOK HOLDER FOR HOLDING SCAFFOLDING ELEMENTS TO A SCAFFOLD

CROSS-REFERENCE TO RELATED APPLICATIONS

The present application is a national phase entry under 35 U.S.C. § 371 of International Application No. PCT/SE02/00758 filed Apr. 17, 2002, published in English, which claims priority from SE 0101359-8 filed Apr. 18, 2001, all of which are incorporated herein by reference.

TECHNICAL FIELD

The present invention relates to a retaining hook according to the preamble of appended claim 1.

BACKGROUND ART

Previously known retaining hooks for blocking a retained position for different scaffold elements at a scaffold normally consists of a hook with a bolt that is displaceable between a blocking position and a releasing position. It must then be verified that the bolt is retained in a blocking position without risk for an unintentional shift. For this purpose, the bolt has to be mounted with well balanced friction or be equipped with a safety lock. Previously known solutions have been relatively expensive, since small tolerances are required and sometimes several movable arts.

DISCLOSURE OF INVENTION

The purpose of the present invention is to present a retaining hook that has an extraordinarily simple construction and which thus is easy to handle, but nevertheless is reliably blocked in the blocking position. Said purpose is achieved by means of retaining hook according to the invention, which characterising features are evident from the appended claim 1.

BRIEF DESCRIPTION OF DRAWINGS

The invention will in the following be described more in detail with an embodiment example with reference to the enclosed drawings, where:

FIGS. 7, 8 and 9 show the retaining hook in different mounting cases, while

PREFERRED EMBODIMENTS

Figure 1:
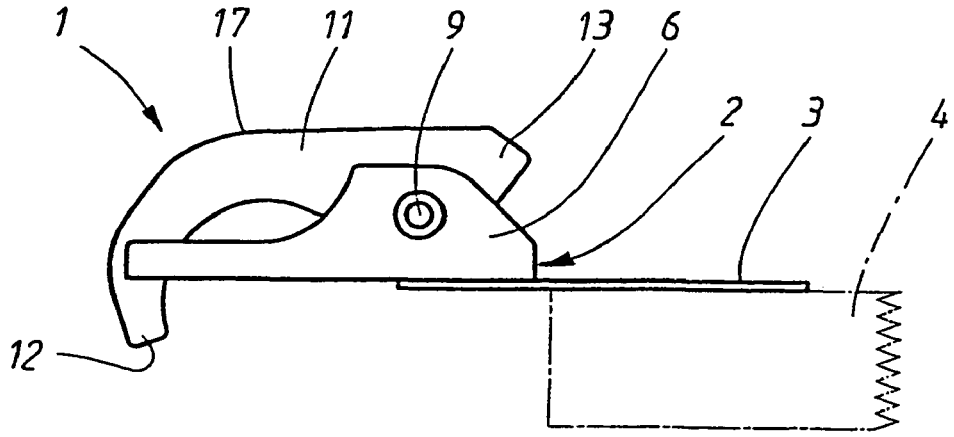
FIGS. 1 and 2 show the retaining hook in a transporting condition in two different views.

As disclosed in FIGS. 1–6, the retaining hook 1 according to the invention consists of a rigid part 2, that is firmly applied to a scaffold element 4 by means of a mounting plate 3, which scaffold element 4 is a first type that shall be retained in position at a scaffold element 5 of the second type. A scaffold element 4, may by way of example, be a deal standing on end or a border that is coupled to the posts, for example at the bottom of the scaffold in order to secure the positions of the pole where they rest on a foundation. Alternatively, a scaffold element of the first type may be a work platform that extends between horizontal scaffold tubes in a scaffold. The scaffold element of the second type is thus either vertical posts 5 in a scaffold or horizontal scaffold tubes that extend between posts in a scaffold. The fixed part 2 comprises a console 6 with a base part 30, which is rigidly connected to the mounting plate 3, for example by means of welding, and two gable parts 7, 8. Between these a pivoting axis 9 extends, which is mounted in the gable parts in its ends and forms bearing for an axis casing 10. On this a pivoted part is applied, which thus is pivotally applied on the axis 9 and thus relative to the fixed part 2. The pivoted part 11 is in the example shown shaped as a hook with a free hook end 12 and a blocking part 13 placed on the opposite side. Alternatively, the axial casing 10 may be rigidly applied on the axis 9, which thus is pivotally (and axially displaceably) carried in holes in the gable parts 7,8.

Except for the fact that the pivoted part 11 is pivoted around its axis 9, it is axially displaceable along the axis or at least a part of the length of the axis. Further, a spring mechanism 14 is arranged, that in the example shown is in the form of a helical spring that forms a compression spring that is preloaded between one of the gable parts 7 and the axial casing 10 and thus strives to retain the pivoted part 11 axially displaced in such a way that the outside face 25 of axials casing 10 bears on the inside of the gable part 8. Further, a recess 15 is arranged in the base part 30, more precisely in one of its edges 16. This recess is placed and dimensioned to receive the end 12 of the pivoted part 11 such that the whole retaining hook has a minimum height in the transporting position according to FIG. 1 and 2. In this position the backwards, upwards facing part 17 of the pivoted part that in the example shown is relatively straight, is positioned mainly parallel to the mounting plate 3.

Figure 3:
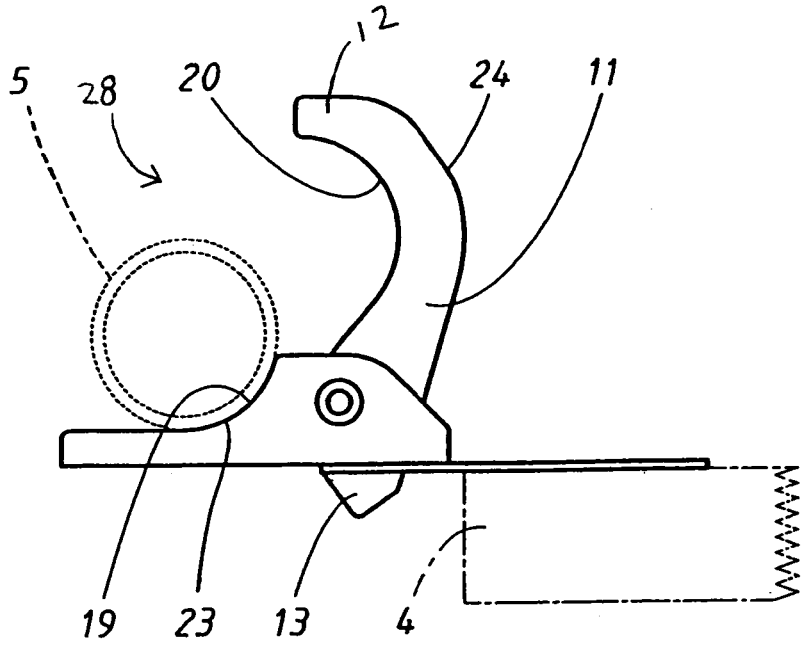
FIGS. 3 and 4 show the retaining hook in a releasing position.
Figure 4:
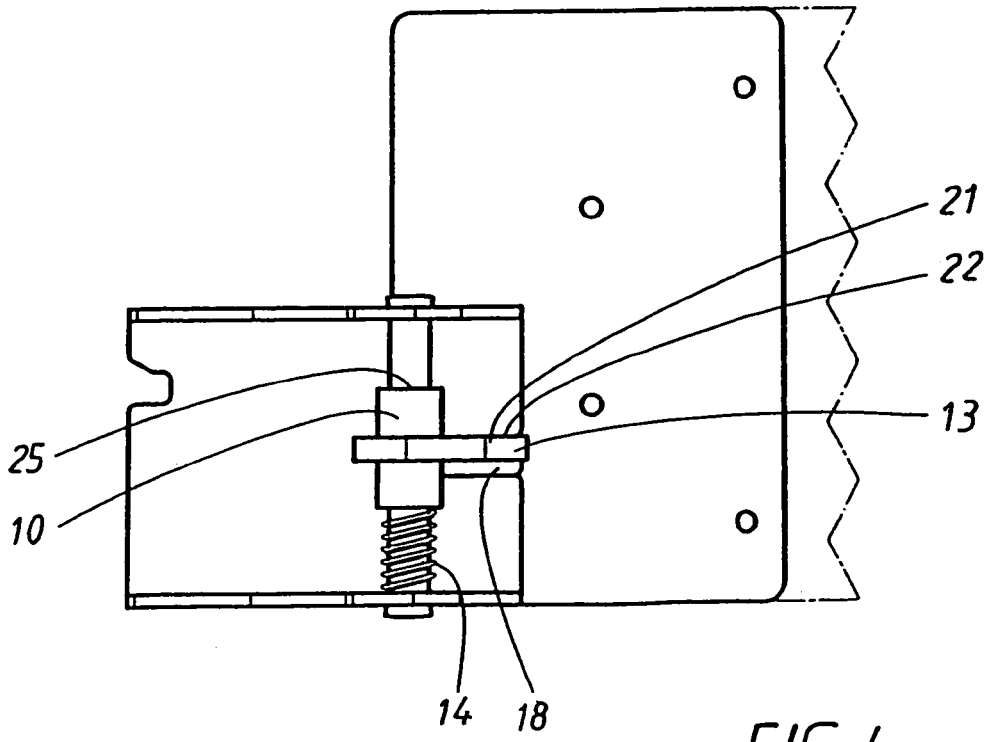

Further, an opening 18 is arranged in the permanent part 2, which opening 18 is arranged to allow rising of the pivoted part 11 to a releasing, not blocked position, by receiving the blocking part 13 of the pivoted part, see FIGS. 3 and 4. For this purpose, the opening 18 is at least somewhat wider than the width of the pivoted part 11 and placed in the vicinity of the axis 9. Further, the opening 18 is longish and extends parallel to the gable parts 7, 8 i.e. transverse the axial direction of the axis 8. Further, the holding hook according to the invention is equipped with two fixed holding surfaces 19 or edges applied on the gable parts 7, 8 of the fixed part and a movable holding surface 20 or edge, applied on the inside of the pivoted part. The holding surfaces 19, 20 are preferably adapted to the profile shape of the scaffold element 5 that is going to be retained, in the example shown an arc-shaped profile shape. The holding surfaces are thus preferably arc-shaped.

Figure 2:
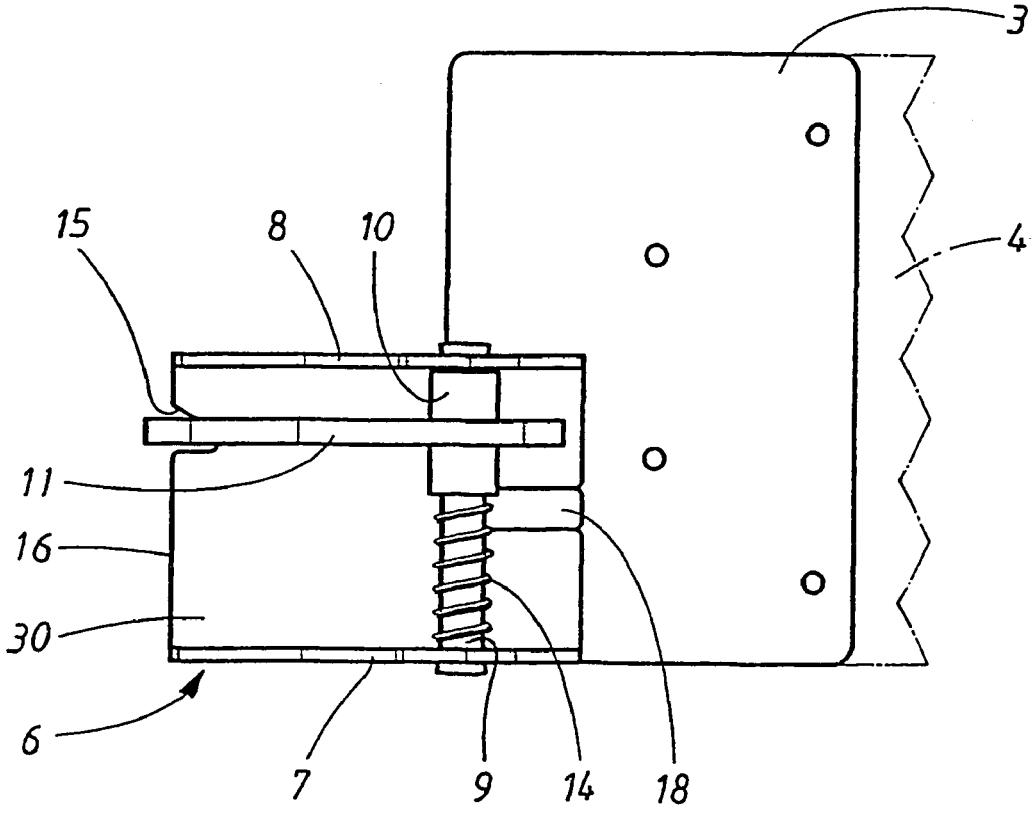

The holding hook according to the invention is easily shifted from a transporting position according to FIG. 1 and 2 to an open, releasing or not blocking position by a person grabbing hold of the pivoting part 11 and bringing it a distance against the load of the compression spring 14 such that the blocking part 13 ends up in front of the opening 18, after which the pivoted part is free to be risen to the position shown in FIG. 3 and 4. When one lets go of the pivoted part 11, the compression spring 14 strives to retain the blocking part 13 against one of the edges 21 of the opening 18. In this way the pivoted part 11 may be retained in an open position by means of friction against the edge 21 of one of the side surfaces 22 of the pivoted part. By means of a side-wards directed protrusion (not shown) or extra high friction in the side surface 22 the opened position may be further secured.

Thus the holding hook may be brought forward towards that scaffold element 5 at which the scaffold element 4 shall be held. The element 5 bears on the holding surfaces 19 with its surface 23, after which the pivoted part 11 may be lowered by pressing the outside 24 of the pivoted part with the hand.

When the blocking part 13 of the pivoted part is risen from the opening 18, allowing the part with its surface 21 to be brought out of contact with the edge 22 of the opening, that pivoted part will be displaced along its pivot axis 9 under the load of the compressions spring 14. A displacement movement is stopped by means of the impact of the end surface 24 of the axial casing 10 against the inside of the gable part 8, see FIG. 6. As the spring force of the compression spring 14 is adapted to keep the pivoted part 11 in this displacement position, the holder block will be blocked as the blocking part 13 is blocked against the upwards facing blocking surface 27 of the base part 5 between the hole 18 and the gable part 8, with a blocking edge 26. By means of optimum dimensioning, the blocking edge 26 is in contact with the blocking surface 27 at a certain uniform diameter of the scaffold element 5, but in practice such tolerances are chosen that a certain play is allowed. The scaffold element 5 is retained in its position when the condition is met that the opening 28 between the hook end 12 and the holding surface 19 of the fixed part 2 falls below the transverse dimension or outer diameter of the element 5. A piece of the gable part 7 has been broken away in FIG. 5 in order to visualise the blocking function. In the example shown, the basic part and the mounting plate 3 are overlapping in the area at the blocking surface 27 and thus extra reinforced.

The purpose with the present invention is thus not to accomplish a rigid locking between two scaffold elements, but a retaining of position primarily viewed in one plane.

Figure 5:
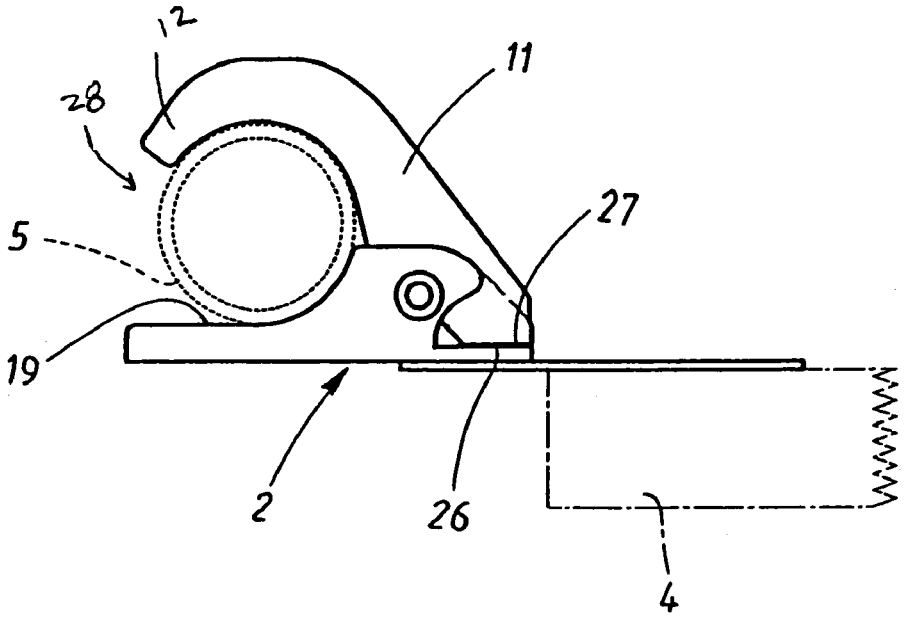
FIGS. 5 and 6 show the retaining hook in a blocked holding position.
Figure 6:
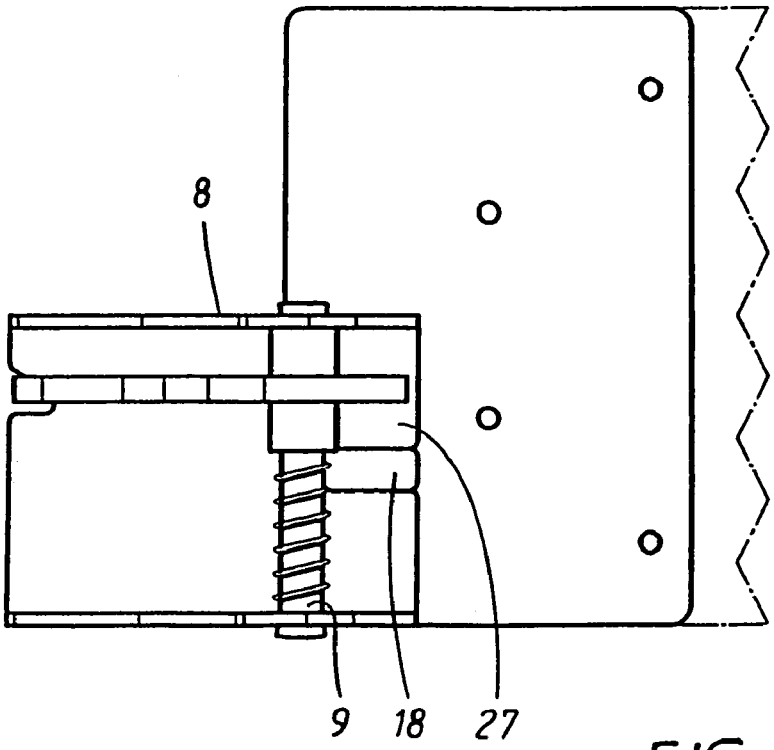

Inversely, the holding hook is easily shifted to a releasing position, by manually catching hold of the pivoting part 11, and bringing it in a direction from the blocking holding position shown in FIGS. 5 and 6 until the pivoted part actually ends up in front of the opening 18 along the axis 9. In this position the pivoted part is free to be raised as the blocking part is allowed to be lowered in the opening 18 and may be retained in an opening position according to FIGS. 3 and 4 in the manner described above. The scaffold elements are thus free to be separated from each other.

Figure 7:
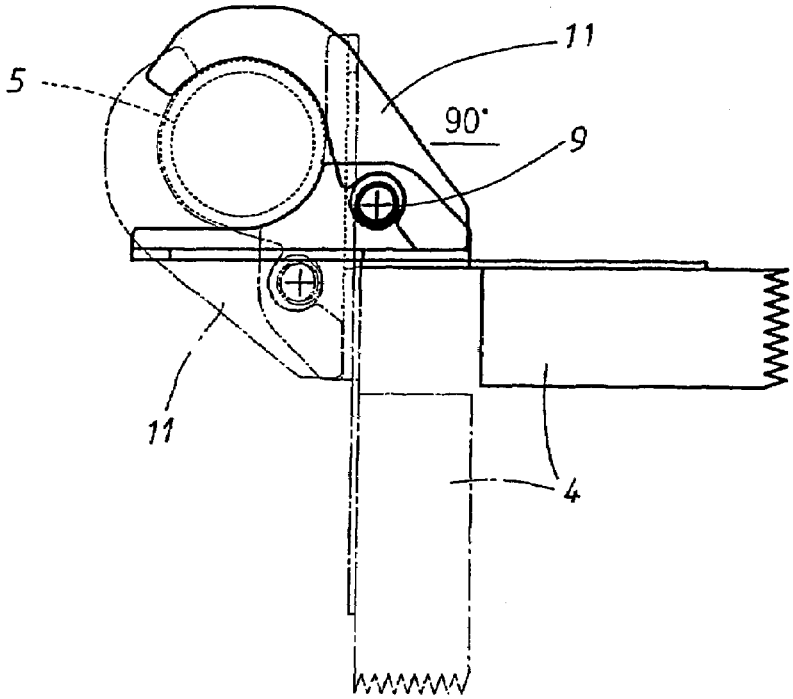
Figure 8:
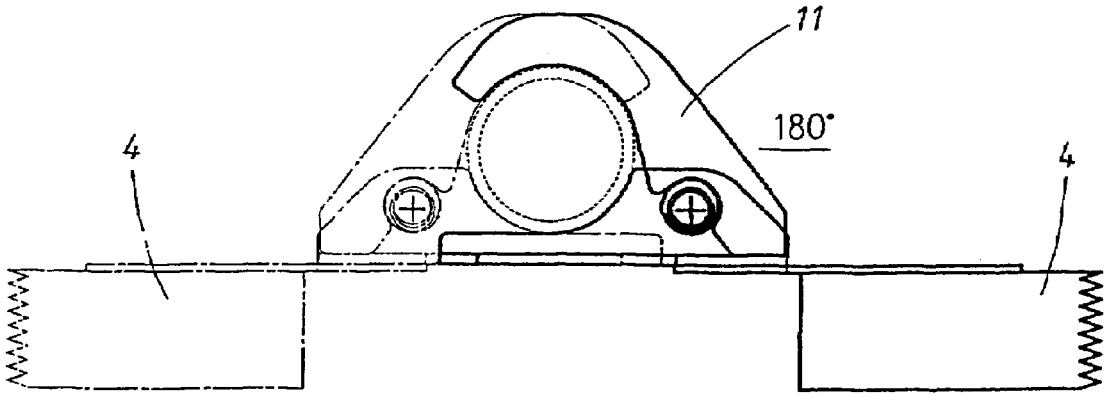
Figure 9:
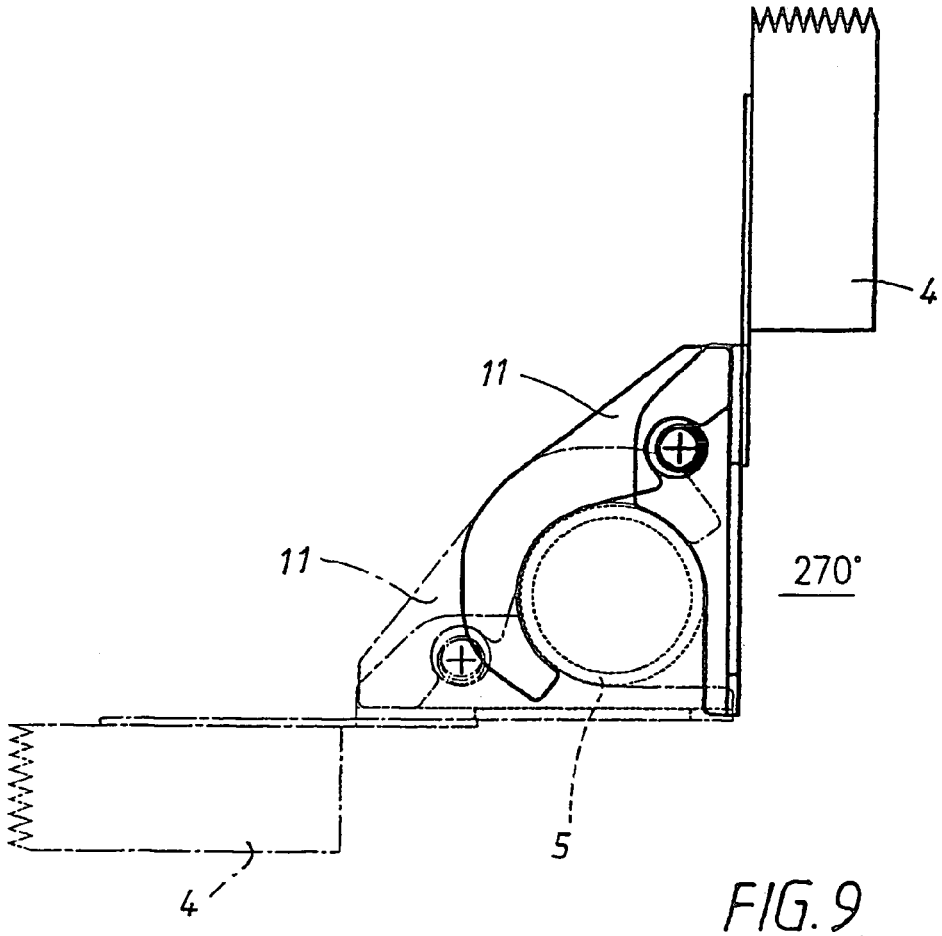

FIG. 7 shows how two scaffold elements 4 may be retained in a position to the scaffold element 5 of the other type, where it is verified that the holding hooks are mutually displaced relative to the longitudinal axis of the scaffold element 5, more precisely with a displacement of the width of the console. In FIG. 7 the two scaffold elements 4 are shown arranged at right angles to each other, i.e. 90° to each other, with the scaffold element 5 outside the corner. FIG. 8 shows the two scaffold elements aligned with each other, i.e. with 180° angle while FIG. 9 shows the scaffold elements 4 at right angles to each other with the scaffold element 5 inside the formed corner i.e. with 270° angle.

Figure 10:
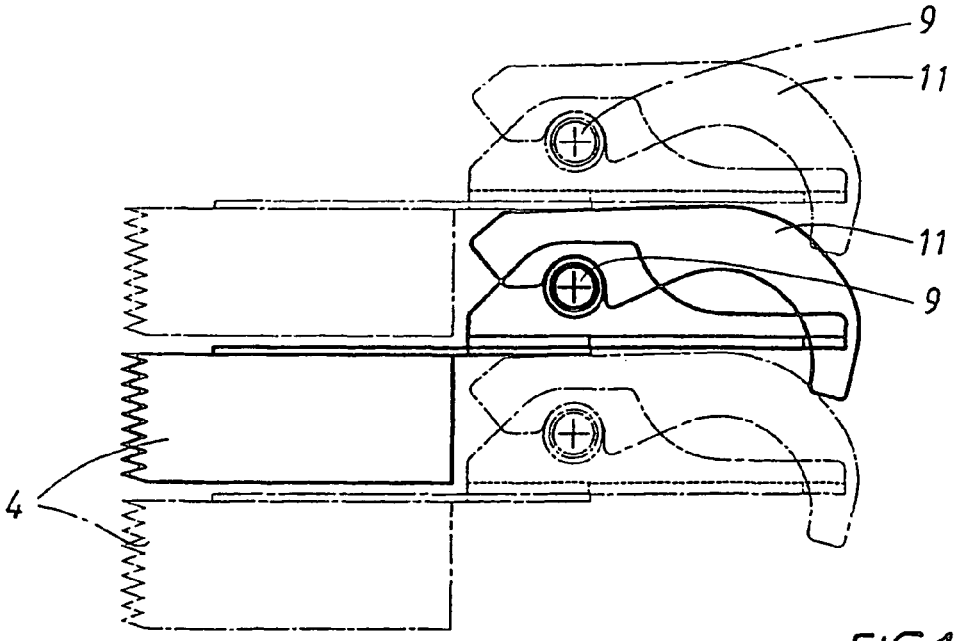
FIG. 10 shows how the retaining hook may be piled for transport.

With the holding hook in transporting position according to FIGS. 1 and 2, the scaffold elements 4 may be piled on each other, as disclosed in FIG. 10, without the holding hooks increasing the height during piling.

The invention is not limited to the embodiments that are described above and shown on the drawings, but may be varied within the scope of the appended claims. For example, it is conceivable that the fixed part, i.e. the console, is arranged in a hook-shaped way, while the pivoted part may be principally straight, possibly hook-shaped. The permanent part may here preferably be placed above the scaffold element 5, for example when horizontal scaffold elements are used for mounting, where the scaffold elements 4 may be work platforms. Only one end of the scaffold element 4 is shown. The opposite end is also suitably equipped with the holding hook according to the invention. At large widths, two or more holding hooks may be mounted at each end. With the axis 9 in the claims, the geometrical axis is concerned since the physical axis may (in an alternative embodiment) follow the movements of the hook.

The invention claimed is:

1. A device for retaining first and second elements relative to each other, said device comprising a holding hook including:

(a) a fixed part for attachment to said first element and having a blocking surface; and (b) a pivotable part pivotally attached to said fixed part about a pivot axis, said pivotable part including a blocking portion and being slideable along said pivot axis between a first position and a second position, said first position being such that said pivotable part is pivotable about said pivot axis along a plane normal to said blocking portion between a holding position for holding said second element and a releasing position for releasing said second element, and said second position being such that said blocking portion abuts said blocking surface when said pivotable part is in said holding position thereby restricting said pivotable part from rotating into said releasing position.

2. The device of claim 1 further including a spring positioned between a first area of said fixed part and a second area of said pivotable part, wherein said spring urges said pivotable part toward said second position.

3. The device of claim 1, wherein said fixed part includes an opening located adjacent to said blocking surface, said opening being dimensioned to allow said blocking portion of said pivotable part to pass therethrough, thereby permitting said pivotable part to rotate between said holding position and said releasing position.

4. The device of claim 3, wherein said fixed part includes a first area and said pivotable part includes a second area, said device further including a spring positioned between said first area of said fixed part and said second area of said pivotable part, wherein said opening includes a supporting edge, and wherein said pivotable part includes a supporting surface, said spring urging said supporting surface into contact with said supporting edge when said pivotable part is in said releasing position, such that said pivotable part is maintained in said releasing position.

* * * * *